US008888321B2

(12) United States Patent
He et al.

(10) Patent No.: US 8,888,321 B2
(45) Date of Patent: Nov. 18, 2014

(54) LIGHT EMITTING MODULE AND BACKLIGHT LIGHTING LAMP CHAIN COMPRISING THE SAME

(75) Inventors: Yuanyuan He, Guangdong (CN); Yaojun Feng, Guangdong (CN); Yubao He, Guangdong (CN); Yabin Luo, Guangdong (CN)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/876,493

(22) PCT Filed: Sep. 5, 2011

(86) PCT No.: PCT/EP2011/065254

§ 371 (c)(1),
(2), (4) Date: Mar. 28, 2013

(87) PCT Pub. No.: WO2012/041638

PCT Pub. Date: Apr. 5, 2012

(65) Prior Publication Data

US 2013/0182434 A1 Jul. 18, 2013

(30) Foreign Application Priority Data

Sep. 29, 2010 (CN) ..... 2010 1 0506225

(51) Int. Cl.

| | |
|---|---|
| ***F21V 31/00*** | (2006.01) |
| ***F21K 99/00*** | (2010.01) |
| ***F21V 31/04*** | (2006.01) |
| ***F21S 4/00*** | (2006.01) |
| ***F21S 8/00*** | (2006.01) |
| *F21Y 101/02* | (2006.01) |

(52) U.S. Cl.

CPC ..... *F21V 31/005* (2013.01); *F21Y 2101/02* (2013.01); *F21K 9/00* (2013.01); *F21V 31/04* (2013.01); *F21S 4/001* (2013.01); *F21S 8/032* (2013.01); *F21S 4/003* (2013.01)

USPC ..... 362/237; 362/235; 362/249.02; 362/309; 362/311.02; 362/311.09

(58) Field of Classification Search

CPC ..... F21V 31/005; F21V 31/04; F21K 9/00; F21Y 2101/02

USPC ..... 362/294.02, 235, 800, 308, 309, 362/311.02, 311.09, 351

See application file for complete search history.

(56) References Cited

U.S. PATENT DOCUMENTS

| | | | | |
|---|---|---|---|---|
| 7,909,482 | B2 * | 3/2011 | Veenstra et al. | 362/249.05 |
| 8,616,724 | B2 * | 12/2013 | Pickard et al. | 362/241 |
| 2009/0272986 | A1 * | 11/2009 | Chan et al. | 257/88 |

FOREIGN PATENT DOCUMENTS

| | | | |
|---|---|---|---|
| WO | 2007047398 | A2 | 4/2007 |
| WO | 2009086032 | A1 | 7/2009 |

* cited by examiner

*Primary Examiner* — Anabel Ton

(57) ABSTRACT

A light emitting module may include: a PCB board; a light emitting assembly mounted on the PCB board; a lens and an encapsulating housing, the encapsulating housing encapsulating therein the PCB board, the light emitting assembly and part of the lens, and an exit surface of the lens being exposed out of the encapsulating housing, wherein the encapsulating housing is formed therein with a first concave region surrounding the exit surface and reducing light blocking, and at least a second concave region into the first concave region, wherein the second concave region is designed in such a way that water in the first concave region is drained via the second concave region.

9 Claims, 3 Drawing Sheets

LIGHT EMITTING MODULE AND BACKLIGHT LIGHTING LAMP CHAIN COMPRISING THE SAME

RELATED APPLICATIONS

The present application is a national stage entry according to 35 U.S.C. §371 of PCT application No.: PCT/EP2011/065254 filed on Sep. 5, 2011, which claims priority from Chinese application No.: 201010506225.6 filed on Sep. 29, 2010.

TECHNICAL FIELD

Various embodiments relate to a light emitting module and a backlight lighting lamp chain including the light emitting module.

BACKGROUND

Usually a backlight lighting lamp chain for outdoor use comprises many light emitting modules, such as LED modules. Hence, each LED module must have fine waterproof performance and then can be used in different weathers. To obtain fine waterproof performance, usually with an over molding process or a low pressure molding process and etc., a packaging material is used to encapsulate the LED modules as a whole. However, some electric components (for example, connectors that need not be welded) in the LED modules are much higher than an LED lens and an LED chip. Hence, after encapsulating the LED modules, a part of emitted light will be blocked by the packaging material. To solve this problem, one solution is to increase the size of the LED lens so that the LED lens is high enough, and then during encapsulating the LED modules, the packaging material will not block the light as emitted. However, this must render a overlarge size of the LED lens, and more packaging material will be used during the encapsulating, as a result, the volume of the overall LED modules will increase correspondingly, and the production cost is then higher and the industrial applicability is also lowered due to the large volume.

The prior art discloses another solution. In this solution, a packaging material is used to encapsulate an LED module comprising an LED lens, wherein, grooves surrounding the LED lens are provided in the circumference of the LED lens, which avoids that the light emitted from the LED lens is blocked by the packaging material. This solution can be applied to an LED module having a relatively small LED lens, while its shortcoming is also very obvious that during actual use, water will stay in the grooves for a long time and gradually infiltrates into the LED module. In addition, dust will also gather in the grooves and thus produce negative effects to lighting effect.

SUMMARY

Various embodiments provide a light emitting module, and when the light emitting module uses a relatively small lens, emitted light will not be blocked by an encapsulating housing, and also, it has fine waterproof effect and dust will not gather around the lens, either. In addition, during encapsulating the light emitting module, a hot liquid packaging material will not damage the lens.

Various embodiments provide a light emitting module which including: a PCB board; a light emitting assembly mounted on the PCB board; a lens and an encapsulating housing, the encapsulating housing encapsulating therein the PCB board, the light emitting assembly and part of the lens, and an exit surface of the lens being exposed out of the encapsulating housing, wherein, the encapsulating housing is formed therein with a first concave region surrounding the exit surface and reducing light blocking, and at least a second concave region into the first concave region, wherein, the second concave region is designed in such a way that water in the first concave region is drained via the second concave region. As the first concave region communicates with the second concave region, rainwater, for example, may be drained from the first concave region, and then the rainwater will not stay in the first concave region for a long time, thereby avoiding that the rainwater immerges into the inside of the light emitting module.

According to various embodiments, two adjacent second concave regions are arranged orthogonal to each other. The gathering rainwater may be more easily drained from the first concave region via the orthogonal arrangement of the second concave regions.

According to various embodiments, the first concave region is formed in a concave arc shape, wherein the first concave region forms a rising arc face outwards from the lens. The first concave region forms a gentle rising arc face, and this prevents the light emitted from the exit surface of the lens from being blocked by the encapsulating housing. In addition, advantageously, the dust will not easily gather in the first concave region and may be easily cleaned. Also, due to the concave arc structure of the first concave region, during encapsulating the light emitting module, the damage of the hot packaging material to the lens is minimized.

According to various embodiments, the second concave region is formed in an arch shape. This concave arch shape has a relatively large flowing section, and rainwater can quickly pass the concave region and is then drained.

According to various embodiments, the PCB board, the light emitting assembly and part of the lens are encapsulated via a low pressure molding process or an over molding process to form the encapsulating housing. This notably improves the waterproof and dust roof performances of the overall light emitting module and can also obtain a beautiful appearance in a simply way.

Other various embodiments provide a backlight lighting lamp chain which includes multiple of the light emitting modules according to the various embodiments. The light emitting module in the backlight lighting lamp chain according to the various embodiments may use a relatively small lens, emitted light will not be blocked by the encapsulating housing, and also, it has fine waterproof effect and dust will not gather around the lens of the light emitting module, either.

It should be understood that the above general description and the following detailed description are for listing and explanation, and aim to provide further explanation of the claimed invention.

BRIEF DESCRIPTION OF THE DRAWINGS

The accompanying drawings constitute a part of the Description and are used to provide further understanding of the present invention. Such accompanying drawings illustrate the embodiments of the present invention and are used to describe the principles of the present invention together with the Description. In the accompanying drawings the same components are represented using the same reference. As shown in the drawings.

DETAILED DESCRIPTION

The following detailed description refers to the accompanying drawings that show, by way of illustration, specific details and embodiments in which the invention may be practiced.

Figure 1:
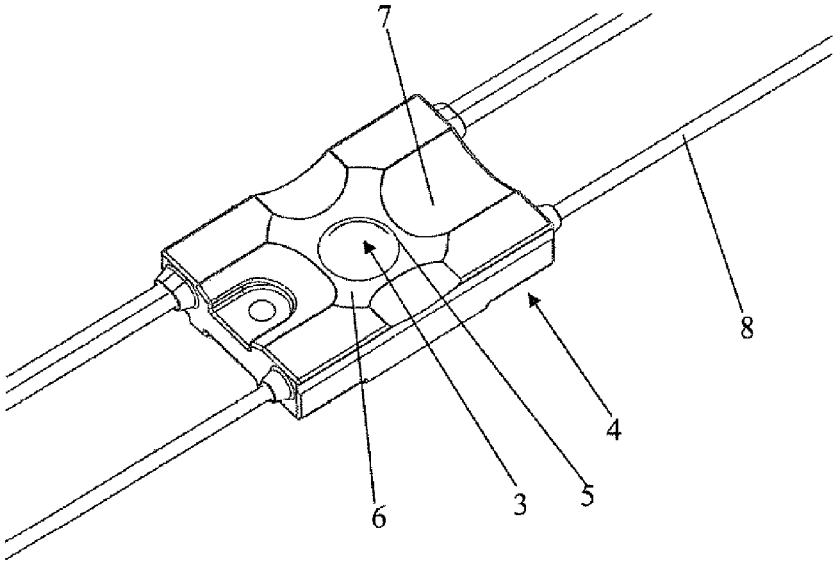
FIG. 1 is a schematic view of the light emitting module according to the present invention.

FIG. 1 illustrates the schematic view of the light emitting module according to the present invention. In this embodiment, the light emitting module is an LED module, and the following description is made using the LED module. Seen from the figure, the encapsulating housing 4 of the LED module encapsulates a part of the lens 3, and the exit surface 5 of the lens 3 is exposed out of the encapsulating housing 4. The encapsulating housing 4 forms at the circumference of the exit surface 5 the first concave region 6 which surrounds the exit surface 5 of the lens 3, and is formed in a concave arc shape and also forms a rising arc face outwards from the lens 3. Also, the encapsulating housing 4 is also formed therein with a second concave region 7 into the first concave region 6, and the second concave region 7 is formed in a concave arch shape. Seen from the figure, the lowermost point at the bottom of the second concave region 7 and the lowermost point at the bottom of the first concave region 6 are within the same plane, so that water in the first concave region 6 can be drained via the second concave region 7. FIG. 1 illustrates four of the second concave region 7, wherein two adjacent second concave regions are arranged orthogonal to each other. Of course, the encapsulating housing 4 according to the present invention can also be formed therein with another number of the second concave region 7.

Figure 2:
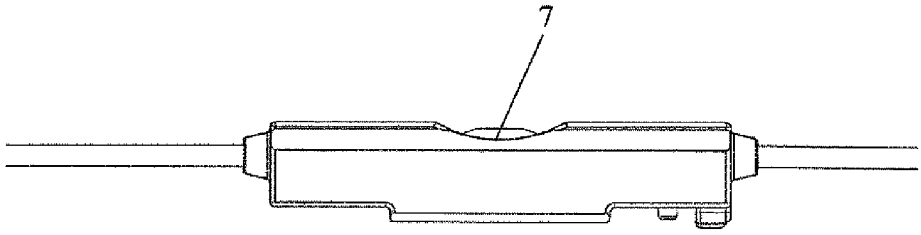
FIG. 2 is a side view of the light emitting module according to the present invention.

FIG. 2 illustrates the side view of the light emitting module according to the present invention, in which the concave arch shape of the second concave region 7 can be clearly seen.

Figure 3:
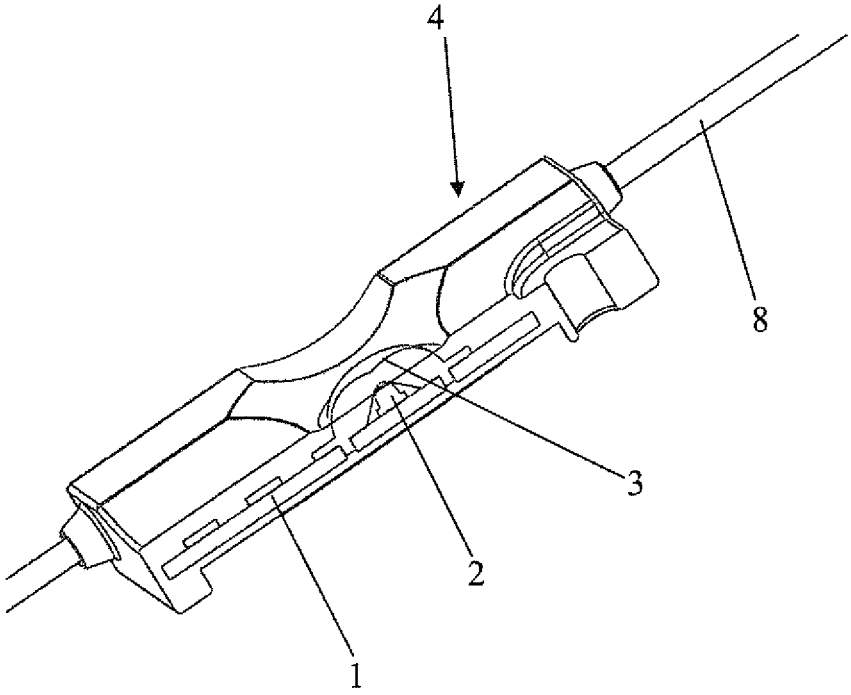
FIG. 3 is a sectional view of the light emitting module according to the present invention.

FIG. 3 illustrates the sectional view of the light emitting module according to the present invention. Seen from the figure, the PCB board 1, the light emitting assembly (LED) 2 and a part of the lens 3 are encapsulated in the encapsulating housing 4. The electrical wire 8 is led out from the encapsulating housing 4.

Figure 4:
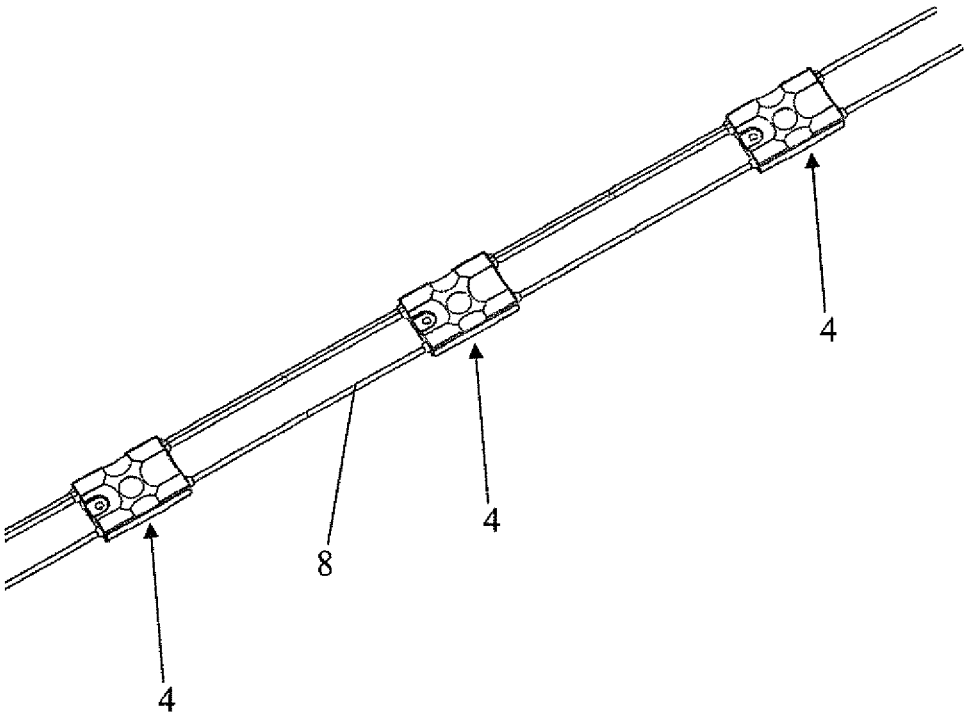
FIG. 4 is a schematic view of the backlight lighting lamp chain comprising multiple of the light emitting module according to the present invention.

FIG. 4 illustrates the schematic view of the backlight lighting lamp chain comprising multiple of the light emitting module according to the present invention. Seen from the figure, the light emitting modules (LED modules) of the backlight lighting lamp chain are connected in series via the electrical wire 8.

The descriptions above are only preferable embodiments of the present invention and are not used to restrict the present invention. For those skilled in the art, the present invention may have various changes and variations. Any modifications, equivalent substitutions, improvements etc. within the spirit and principle of the present invention shall all be included in the scope of protection of the present invention.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

REFERENCE SIGNS

1 PCB board
2 light emitting assembly (LED)
3 lens
4 encapsulating housing
5 exit surface
6 first concave region
7 second concave region
8 electrical wire

The invention claimed is:

1. A light emitting module, comprising: a PCB board; a light emitting assembly mounted on the PCB board; a lens and an encapsulating housing, the encapsulating housing encapsulating therein the PCB board, the light emitting assembly and part of the lens, and an exit surface of the lens being exposed out of the encapsulating housing, wherein the encapsulating housing is formed therein with a first concave region surrounding the exit surface and reducing light blocking, and at least a second concave region into the first concave region, wherein the second concave region is configured in such a way that water entering the first concave region is drained via the second concave region.

2. The light emitting module according to claim 1, wherein two adjacent second concave regions are arranged orthogonal to each other.

3. The light emitting module according to claim 1, wherein the first concave region is formed in a concave arc shape, wherein the first concave region forms a rising arc face outwards from the lens.

4. The light emitting module according to claim 1, wherein the second concave region is formed in an arch shape.

5. The light emitting module according to claim 1, wherein the PCB board, the light emitting assembly and part of the lens are encapsulated via a low pressure molding process or an over molding process to form the encapsulating housing.

6. A backlight lighting lamp chain, wherein the backlight lighting lamp chain comprises a plurality of the light emitting modules, the light emitting modules comprise: a PCB board; a light emitting assembly mounted on the PCB board; a lens and an encapsulating housing, the encapsulating housing encapsulating therein the PCB board, the light emitting assembly and part of the lens, and an exit surface of the lens being exposed out of the encapsulating housing, wherein the encapsulating housing is formed therein with a first concave region surrounding the exit surface and reducing light blocking, and at least a second concave region into the first concave region, wherein the second concave region is configured in such a way that water entering the first concave region is drained via the second concave region.

7. The light emitting module according to claim 2, wherein the first concave region is formed in a concave arc shape, wherein the first concave region forms a rising arc face outwards from the lens.

8. The light emitting module according to claim 2, wherein the second concave region is formed in an arch shape.

9. The light emitting module according to claim 2, wherein the PCB board, the light emitting assembly and part of the lens are encapsulated via a low pressure molding process or an over molding process to form the encapsulating housing.

* * * * *